US011801876B2

(12) United States Patent
Richmond et al.

(10) Patent No.: US 11,801,876 B2
(45) **Date of Patent: *Oct. 31, 2023**

(54) HOURGLASS AUTORACK CAR

(71) Applicant: Trinity North American Freight Car, Inc., Dallas, TX (US)

(72) Inventors: Shaun Richmond, Frankfort, IL (US); Brant R. McGhee, Arlington, TX (US); Kenneth W. Huck, Fairview, TX (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 456 days.

This patent is subject to a terminal disclaimer.

(21) Appl. No.: 17/061,210

(22) Filed: Oct. 1, 2020

(65) Prior Publication Data

US 2021/0016807 A1 Jan. 21, 2021

Related U.S. Application Data

(63) Continuation-in-part of application No. 16/450,275, filed on Jun. 24, 2019, now Pat. No. 10,889,306, which is a continuation of application No. 15/214,827, filed on Jul. 20, 2016, now Pat. No. 10,328,953.

(60) Provisional application No. 62/338,254, filed on May 18, 2016.

(51) Int. Cl.
*B61D 3/02* (2006.01)
*B61D 3/18* (2006.01)

(52) U.S. Cl.
CPC ..... *B61D 3/18* (2013.01)

(58) Field of Classification Search
CPC ..... B61D 3/187; B61D 3/181; B61D 17/12; B61D 3/18; B61D 17/08; B61D 3/02; B61D 1/06; B61D 3/185
See application file for complete search history.

(56) References Cited

U.S. PATENT DOCUMENTS

| | | | | |
|---|---|---|---|---|
| 5,392,717 | A * | 2/1995 | Hesch | B61D 17/005 105/18 |
| 6,213,028 | B1 * | 4/2001 | Fetterman | B61D 7/02 105/238.1 |
| 6,865,992 | B1 | 3/2005 | Fetterman et al. | |
| 7,735,426 | B2 | 6/2010 | Creighton et al. | |
| 7,784,411 | B2 | 8/2010 | Forbes et al. | |
| 7,823,514 | B2 | 11/2010 | Forbes et al. | |
| 8,356,560 | B2 | 1/2013 | Forbes et al. | |
| 8,915,194 | B2 | 12/2014 | Creighton et al. | |

(Continued)

*Primary Examiner* — Mark T Le
(74) *Attorney, Agent, or Firm* — BAKER BOTTS L.L.P.

(57) ABSTRACT

According to some embodiments, an articulated railcar comprises a first railcar and a second railcar coupled via an articulated railcar truck. The first railcar and the second railcar each comprise a first end, a second end, and a first longitudinal side and a second longitudinal side disposed between the first end and the second end. The first longitudinal side comprises a center panel and an intermediate panel. The center panel is disposed between a center of the railcar and the intermediate panel. The intermediate panel is disposed between the center panel and the first end or the second end. A width of the railcar at the intermediate panel is greater than a width of the railcar at the center panel.

20 Claims, 5 Drawing Sheets

(56) References Cited

U.S. PATENT DOCUMENTS

| | | | | |
|---|---|---|---|---|
| 9,156,478 | B2 | 10/2015 | Forbes et al. | |
| 10,328,953 | B2 * | 6/2019 | Richmond | B61D 3/18 |
| 2009/0090268 | A1 * | 4/2009 | Early | B61D 7/02 105/247 |
| 2013/0263757 | A1 | 10/2013 | Rezaei et al. | |
| 2014/0130706 | A1 | 5/2014 | Hematian | |
| 2014/0130707 | A1 | 5/2014 | Batchelor | |
| 2016/0039432 | A1 | 2/2016 | Cencer | |
| 2017/0334462 | A1 | 11/2017 | Richmond | |
| 2018/0015934 | A1 | 1/2018 | Bis | |

* cited by examiner

HOURGLASS AUTORACK CAR

PRIORITY

This application is a continuation-in-part, under 35 U.S.C. § 120, of U.S. application Ser. No. 16/450,275 "HOURGLASS AUTORACK CAR" filed on Jun. 24, 2019, which is a continuation of U.S. application Ser. No. 15/214,827 "HOURGLASS AUTORACK CAR" filed on Jul. 20, 2016, which claims priority to U.S. Provisional Patent Application No. 62/338,254 filed May 18, 2016, all of which are hereby incorporated by reference in their entirety.

TECHNICAL FIELD OF THE INVENTION

This disclosure generally relates to railcars, and more particularly to an hourglass shaped autorack railcar.

BACKGROUND

An autorack railcar (also referred to as an auto carrier or car transporter) is a railcar for transporting automobiles and light trucks. For example, an autorack railcar may transport vehicles from a manufacturing facility to a distributorship, or transport vehicles for passengers of a passenger train service.

An autorack railcar generally includes two or three decks for transporting vehicles. Some autorack railcars are convertible between two and three decks. The cars are typically fully enclosed with continuous side panels, end doors, and roofs to protect the vehicles from severe weather, theft/vandalism, or other in-transit damage.

To load an autorack railcar, a skilled driver drives the vehicle up a ramp and onto one of the decks. The driver or another crew member then secures the vehicle to the deck with tie down straps, chains, etc. The process is reversed to unload the autorack railcar.

Conventional autorack railcars typically have limited interior width for personnel to maneuver between the side panels of the railcar and vehicles loaded in the railcar. This problem is more noticeable with wide vehicles, such as pickup trucks with sets of dual rear wheels, or vehicles without folding mirrors.

A conventional autorack railcar may be a constant width (e.g., 9' 11") for the length of the railcar. Railcar width is constrained by American Association of Railroads (AAR) regulations in Standard S-2030 Plate D, S-2047 Plate J, and S-2048 Plate K. Plates J and K describe the overall equipment diagram for railcars up to 19' 0" and 20' 3" tall, respectively.

SUMMARY OF THE INVENTION

The constant width of a conventional autorack railcar provides limited interior width for personnel to maneuver between the side panels of the railcar and the vehicles loaded in the railcar. The embodiments described herein include a variable width, hourglass-shaped autorack railcar.

According to some embodiments, a railcar comprises a first end and a second end. A first longitudinal side and a second longitudinal side are disposed between the first end and the second end. The first longitudinal side comprises a center panel and an intermediate panel. The center panel is disposed between a center of the railcar and the intermediate panel. The intermediate panel is disposed between the center panel and the first end or the second end. A width of the railcar at the intermediate panel is greater than a width of the railcar at the center panel. The center panel and the intermediate panel comprise generally straight panels coupled together at an angle. In particular embodiments, the first longitudinal side may further comprise an end panel disposed between the intermediate panel and the first end or the second end.

In particular embodiments, the width of the railcar at the intermediate panel may be approximately 10 feet 8 inches and the width of the railcar at the center panel may vary from approximately 9 feet 11 inches proximate the center of the railcar to approximately 10 feet 8 inches proximate the intermediate panel. In embodiments with an end panel, the width of the railcar at the end panel may vary from approximately 10 feet 8 inches proximate the intermediate panel to approximately 10 feet 3 inches proximate the first end or the second end.

In particular embodiments, the center panel is approximately 18 feet long and the intermediate panel is approximately 25 feet long. In embodiments with an end panel, the end panel is approximately 2 feet long.

In particular embodiments, the width of the railcar at the center panel is generally constant along a vertical dimension of the railcar.

According to some embodiments, an autorack railcar comprises a first end and a second end. A first longitudinal side and a second longitudinal side are disposed between the first end and the second end. A rack for transporting vehicles is generally enclosed by the first end, the second end, the first longitudinal aide, and the second longitudinal side. A first width of the autorack railcar between the first longitudinal side and the second longitudinal side proximate a center of the autorack railcar comprises a first width value. A second width of the autorack railcar between the first longitudinal side and the second longitudinal side between the center of the autorack railcar and either the first end or the second end comprises a second width value. The second width value is greater than the first width value. The first width and the second width are generally constant along a vertical dimension of the autorack railcar. In some embodiments, a third width of the autorack railcar between the first longitudinal side and the second longitudinal side proximate either the first end or the second end comprises a third width value. The third width value greater than or equal to the first width value and less than or equal to the second width value. The third width value is generally constant along a vertical dimension of the autorack railcar.

In particular embodiments, the first width value is approximately 9 feet 11 inches, the second width value is approximately 10 feet 8 inches, and the third with value is approximately 10 feet and 3 inches.

In some embodiments, a method of manufacturing an autorack railcar comprises providing a first end and a second end. The method further comprises coupling a first longitudinal side and a second longitudinal side between the first end and the second end to enclose a rack for transporting vehicles. The first longitudinal side comprises a center panel and an intermediate panel. The center panel is disposed between a center of the railcar and the intermediate panel. The intermediate panel is disposed between the center panel and the first end or the second end. The center panel and the intermediate panel comprise generally straight panels. In some embodiments, the first longitudinal side further comprises an end panel disposed between the intermediate panel and the first end or the second end. The end panel may comprise a generally straight panel. The method further comprises positioning the center panel a first distance from the second longitudinal side and positioning the intermediate panel a second distance from the second longitudinal side. The second distance is greater than the first distance. In some embodiments, the method further comprises positioning the end panel a third distance from the second longitudinal side. The third distance is greater than or equal to the first distance and less than or equal to the second distance.

In particular embodiments, the first distance is less than 10 feet, the second distance is greater than 10. The center panel, the intermediate panel, and the end panel may comprise generally straight panels.

As a result, particular embodiments of the present disclosure may provide numerous technical advantages. For example, the additional autorack railcar width provides additional room within the railcar, which improves crew ergonomics by providing more room to conduct normal operations and reduces the likelihood of vehicle damage caused by close working conditions. Particular embodiments of the present disclosure may provide some, none, all, or additional technical advantages.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Conventional fixed-width autorack railcars provide limited interior space for personnel to maneuver between the side panels of the railcar and the vehicles loaded in the railcar. Particular embodiments obviate the problems described above and include a variable width, hourglass-shaped autorack railcar.

AAR Plate K permits modification of maximum railcar width under particular conditions, such as truck center distance, car height, etc. The maximum width at any longitudinal location along a railcar may be determined by a formula. Particular embodiments include a variable width railcar that complies with regulations while also providing additional width and interior clearance (e.g., up to 4.5" per side) for much of the length of the railcar. The additional interior clearance improves crew ergonomics by providing more room to conduct normal operations and reduces the likelihood of vehicle damage caused by close working conditions.

As an example, AAR Plate J restricts railcar width to a 10' 8" maximum at any location for a railcar with truck centers spaced at 55' 1" apart. The maximum width at the center of a railcar with a common truck spacing of, for example, 66' is approximately 9' 11". Moving longitudinally outward from the center of the railcar, the maximum width increases to 10' 8". Using a 90' railcar as an example, the permissible width approximately 18' from the center of the car outward to approximately 43' is 10' 8". From 43' outward to the end of the railcar (i.e., 45'), the permissible width is approximately 10' 3.8".

Particular embodiments take advantage of the variable width requirements to expand the width of an autorack railcar at particular locations beneficial for the crew that loads or unloads the autorack railcar. For example, although the maximum width at the center of an autorack railcar with a common truck spacing of 66' is approximately 9' 11", the width of the autorack railcar may be wider in other locations. Particular embodiments include an hourglass-shaped autorack railcar where the autorack railcar is narrow at a center point and gets wider towards each end of the car. Particular embodiments provide extra width at the locations where an operator entering or exiting a vehicle during the loading/unloading process may benefit from extra maneuverability.

Plate K specifies requirements for taller railcars. Particular embodiments may include hourglass-shaped autorack railcars for any suitable configuration or combination of truck center distances, railcar lengths, railcar heights, or other suitable parameters.

Particular embodiments and their advantages are best understood by reference to FIGS. 1-8 wherein like reference numbers indicate like features.

Figure 1:
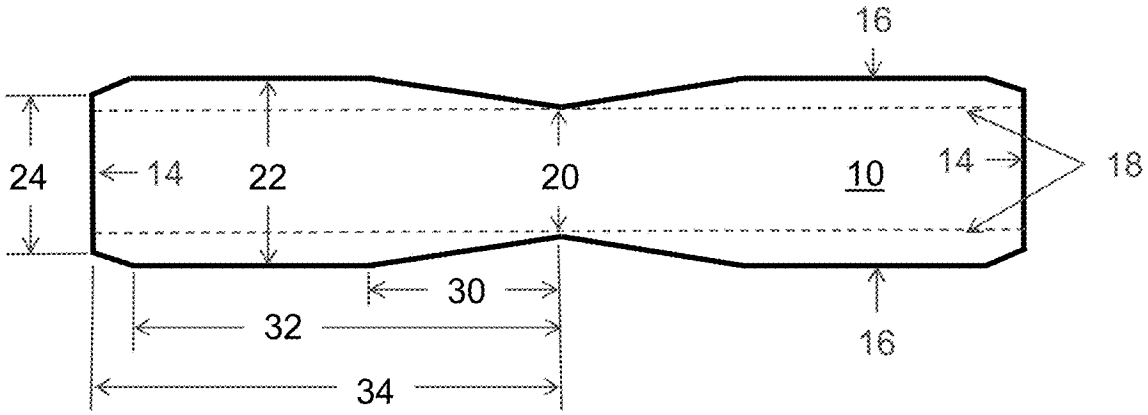
FIG. 1 is a schematic diagram overhead view of an autorack railcar, according to some embodiments.

FIG. 1 is a schematic diagram overhead view of an autorack railcar, according to some embodiments. Autorack railcar 10 includes ends 14 and longitudinal sides 16. Longitudinal sides 16 and ends 14 enclose a rack for transporting vehicles and generally protect the vehicles from the elements during transport.

Autorack railcar 10 includes variable widths along the longitudinal length (i.e., variable width between longitudinal sides 16) of the railcar. Dashed lines 18 represent the fixed width of a conventional autorack railcar.

In particular embodiments, the width of autorack railcar 10 approximates an hourglass shape with a minimum width 20 at the center of autorack railcar 10 and a width that expands over the distance 30 to a maximum width 22. The maximum width 22 continues out to distance 32 and then reduces to end width 24 at distance 34. As illustrated, particular embodiments provide additional width than a conventional autorack railcar (represented by dashed lines 18) at particular locations along the length of railcar 10. The additional width may provide additional room for crew members to operate and may reduce the chances of vehicle damage.

As a particular example, autorack railcar 10 may comprise a 90' railcar with trucks spaced at 66'. In this example, minimum width 20 is approximately 9' 11". The width of autorack railcar 10 may gradually increase over distance 30 (e.g., approximately 18' from center) to maximum width 22. In this example, maximum width 22 is approximately 10' 8". The width of autorack railcar 10 may be a constant 10' 8" between distance 30 (e.g., approximately 18' from center) and distance 32 (e.g., approximately 43' from center). At the end of autorack railcar 10, its width may gradually reduce between distance 32 (e.g., approximately 43' from center) and 34 (e.g., approximately 45' from center) to end width 24. In this example, end width 24 is approximately 10' 3.8".

Accordingly, some portions of the example autorack railcar 10 (e.g., the portion having width 22) may be up to approximately 9" wider than a conventional fixed width autorack railcar (i.e., 10' 8"−9' 11"=9"). The additional 9" may provide extra clearance (e.g., up to 4.5") on each side of a vehicle loaded in autorack railcar 10, which provides additional room for a crew to perform interior operations in autorack railcar 10. Other embodiments may include any suitable dimensions.

Figure 2:
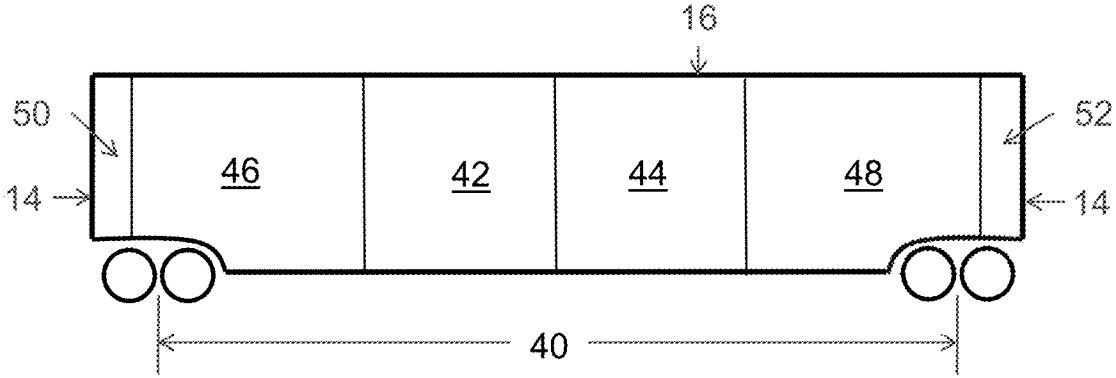
FIG. 2 is a schematic diagram side view of an autorack railcar, according to some embodiments.

FIG. 2 is a schematic diagram side view of an autorack railcar, according to some embodiments. FIG. 2 illustrates a side view, for example, of autorack railcar 10 described with respect to FIG. 1. Autorack railcar 10 includes truck center distance 40. The side panels of autorack railcar 10 include left center panel 42, right center panel 44, left intermediate panel 46, right intermediate panel 48, left end panel 50, and right end panel 52.

Left center panel 42 and right center panel 44 are positioned on each side of the center line of autorack railcar 10. Railcar 10 has a minimum width at the center of left center panel 42 and right center panel 44. Moving outward longitudinally from the center of autorack railcar 10, autorack railcar 10 has a maximum width along the length of left intermediate side panel 46 and right intermediate side panel 48. The width of autorack railcar 10 reduces again along left end panel 50 and right end panel 52. Although the various panels 42, 44, 46, 48, 50 and 52 are described as a single panel, in particular embodiments each panel may comprise any number of panels or sub-panels.

As a particular example, autorack railcar 10 may comprise a 90' railcar and truck center distance 40 may be approximately 66'. The width of autorack railcar 10 at left center panel 42 may be approximately 9' 11" at the center of the railcar. Left center panel 42 may be approximately 18' in length and the width of autorack railcar 10 may be approximately 10' 8" at the leftmost side of center panel 42. Right center panel 44 may be approximately 18' in length and the width of autorack railcar 10 may be approximately 10' 8" at the rightmost side of right center panel 44.

The width of autorack railcar 10 for the length of left intermediate side panel 46 and right intermediate side panel 48 may be approximately 10' 8". Left intermediate side panel 46 and right intermediate side panel 48 may be approximately 25' in length.

Left end panel 50 and right end panel 52 may be approximately 2' in length. The width of autorack railcar 10 is approximately 10' 8" at the rightmost side of left end panel 50 and approximately 10' 3.8" at the leftmost side of left end panel 50. The width of autorack railcar 10 is approximately 10' 8" at the leftmost side of right end panel 52 and approximately 10' 3.8" at the rightmost side of right end panel 52.

In particular embodiments, the width of autorack railcar 10 is generally constant over a vertical dimension of autorack railcar 10. For example, the width of autorack railcar 10 at any particular location along longitudinal sides 16 is the same width from the bottom of longitudinal side 16 (e.g., near the railcar floor) to the top of longitudinal side 16 (e.g., near the railcar roof). As a particular example, the width of autorack railcar 10 at left intermediate side panel 46 may be 10' 8". The width of autorack railcar 10 at left intermediate side panel 46 is generally a constant 10' 8" across the vertical dimension of left intermediate side panel 46 (e.g., generally constant from floor to roof).

Other embodiments may include any suitable dimensions or any suitable number of side panels. For example, particular embodiments may not include left end panel 50 or right end panel 52. In such embodiments, left intermediate side panel 46 and/or right intermediate side panel 48 may extend to the end of autorack railcar 10, and the width of autorack railcar 10 may be constant (e.g., approximately 10' 3.8" in some embodiments) along the length of left intermediate side panel 46 and/or right intermediate side panel 48.

The example autorack railcar illustrated in FIGS. 1 and 2 includes generally straight side panels that may be connected at various angles to transition between the various widths at the various locations along the length of the railcar. For example left end panel 50, left intermediate side panel 46, and left center panel 42 may all comprise panels that are straight along their horizontal dimension. Left end panel 50 is coupled to left intermediate side panel 46 at a first angle, and left intermediate side panel 46 is coupled to left center panel 42 at a second angle to vary the width along the longitudinal direction of autorack railcar 10. In particular embodiments, generally straight side panels may be relatively easy and inexpensive to manufacture compared to other configurations. Other embodiments may include other types of side panels, such as curved side panels, or a combination of straight and curved side panels.

Figure 3:
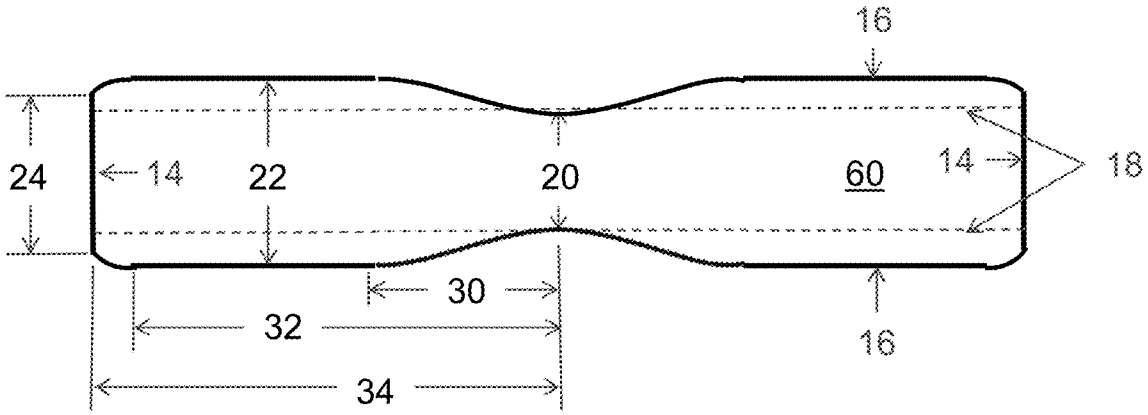
FIG. 3 is a schematic diagram overhead view of another autorack railcar, according to some embodiments.

FIG. 3 is a schematic diagram overhead view of another autorack railcar, according to some embodiments. Autorack railcar 60 is similar to autorack railcar 10 illustrated in FIG. 1, except autorack railcar 60 includes curved side panels.

For example, each longitudinal side 16 may include curved side panels that curve between the centerline and distance 30 on either side of the center line. In particular embodiments, the curved side panel may comprise a single curved side panel or a combination of several curved sub-panels. In particular embodiments, the curved side panels may be curved for the vertical length of the panel (e.g., the side panel may be curved from floor to roof).

As another example, each longitudinal side 16 may include curved side panels near each end 14 of autorack railcar 60, such as between distances 32 and 34. Although each curve is illustrated with a particular radius, other embodiments may include any suitable radius to maximize the interior space of an autorack railcar without exceeding width regulations at any particular point along the length of the railcar.

Figure 4:
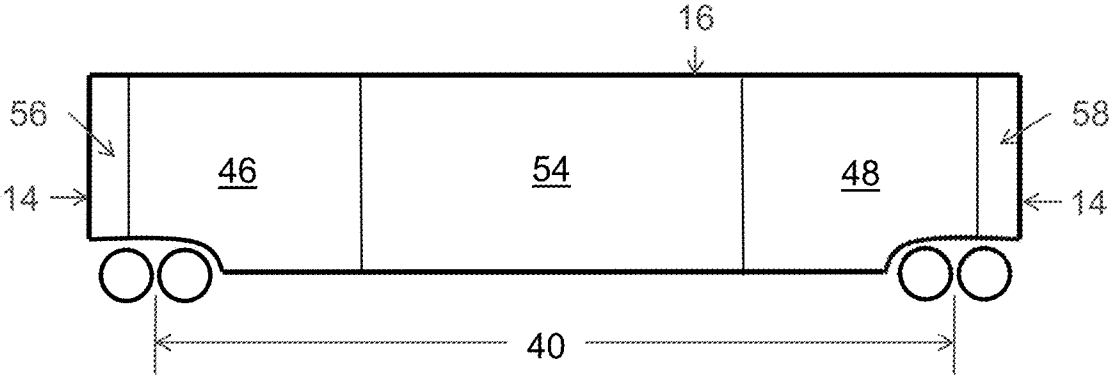
FIG. 4 is a schematic diagram side view of another autorack railcar, according to some embodiments.

FIG. 4 is a schematic diagram side view of another autorack railcar, according to some embodiments. FIG. 4 illustrates a side view, for example, of autorack railcar 60 described with respect to FIG. 3. Longitudinal side 16 of the autorack railcar includes curved side panels 54, 56, and 58.

In particular embodiments, the racks for transporting vehicles within an autorack railcar may be positioned or configured with the respect to the autorack railcar width dimensions to optimize crew access to the vehicles for transport. For example, the rack may be configured such that the hood or trunk portion of the vehicle is located in the narrower width portion of the autorack railcar, and vehicle openings, such as the driver side window and door, are located in the wider portion of the autorack railcar.

Figure 5:
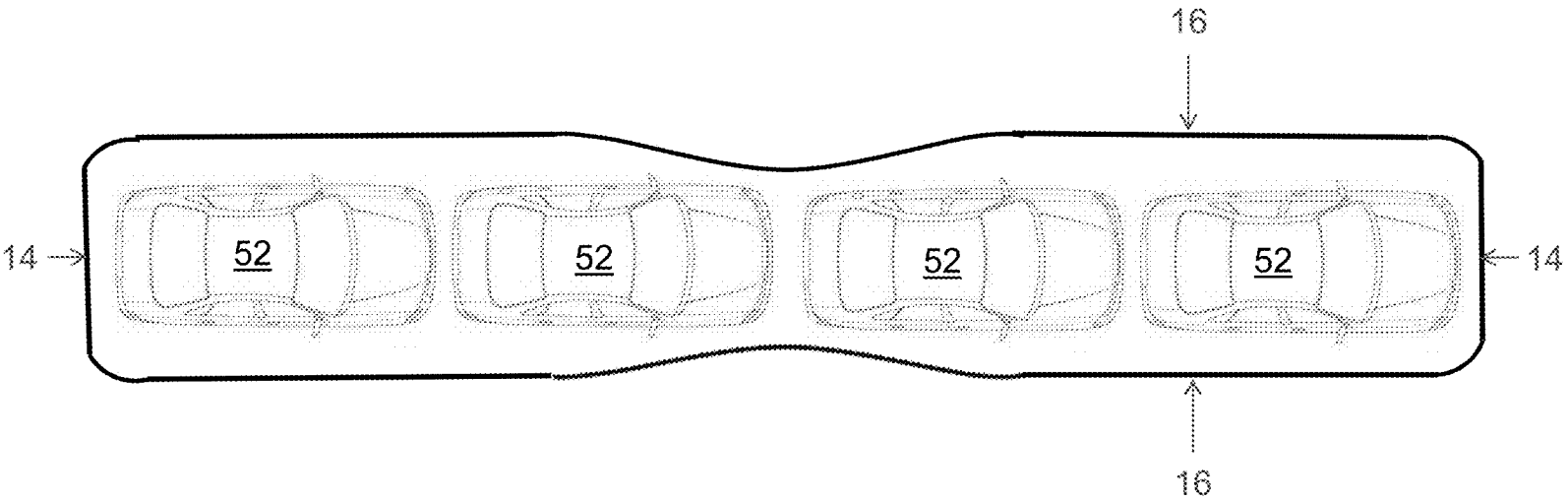
FIG. 5 is a schematic diagram overhead view of an example autorack loaded with vehicles, according to a particular embodiment.

FIG. 5 is a schematic diagram overhead view of an example autorack loaded with vehicles, according to a particular embodiment. The example autorack railcar, such as autorack railcar 10 described with respect to FIGS. 1 and 2 or autorack railcar 60 described with respect to FIGS. 3 and 4, includes vehicles 52. Although 4 vehicles are illustrated, particular embodiments may include any suitable number of vehicles on one or more decks.

As illustrated, the varying width of longitudinal sides 16 provides extra room for maneuvering around vehicles 52.

The extra room is particularly advantageous when vehicles 52 comprise wide vehicles, such as pickup trucks with sets of dual rear wheels, or when vehicles 52 comprise vehicles without folding mirrors.

Figure 6:
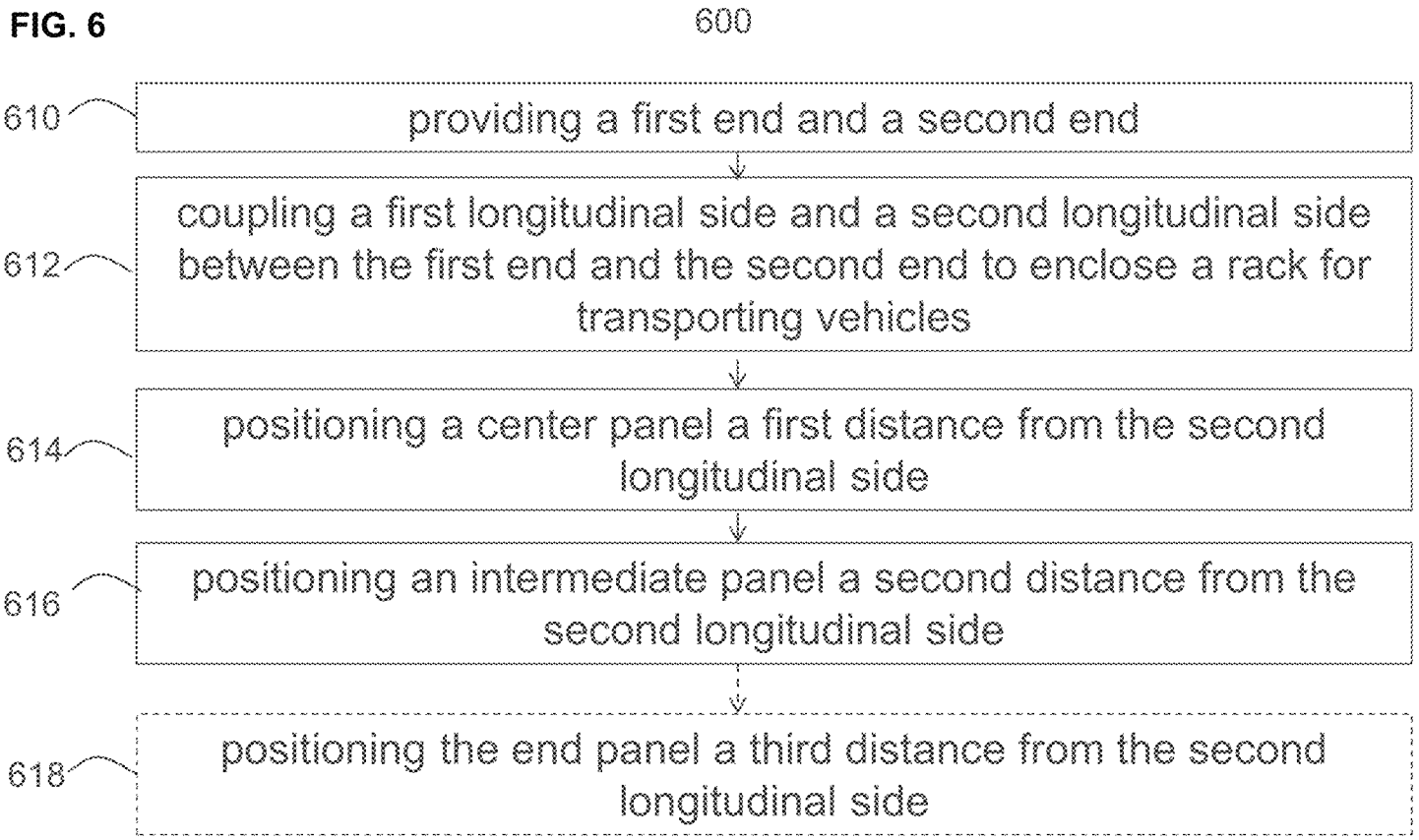
FIG. 6 is a flow diagram illustrating an example method of manufacturing an autorack railcar, according to some embodiments.

FIG. 6 is a flow diagram illustrating an example method of manufacturing an autorack railcar, according to some embodiments. In particular embodiments, one or more steps of method 600 may be performed to manufacture a railcar, such as the autorack railcars described with respect to FIGS. 1-5.

The method begins at step 610 by providing a first end and a second end. For example, the first end and second end may comprise any of ends 14 described with respect to FIGS. 1-5.

At step 612, a first longitudinal side and a second longitudinal side are coupled between the first end and the second end to enclose a rack for transporting vehicles. For example, any of longitudinal sides 16 described with respect to FIGS. 1-5 may be coupled to any of ends 14.

In particular embodiments, the first longitudinal side comprises a center panel and an intermediate panel. The center panel is disposed between a center of the railcar and the intermediate panel. The intermediate panel is disposed between the center panel and the first end or the second end. For example, the center panel may comprise any of left center panel 42, right center panel 44, or curved side panel 54, and the intermediate panel may comprise any of left intermediate panel 46 or right intermediate panel 48 described with respect to FIGS. 1-5.

At step 614, a center panel is positioned a first distance from the second longitudinal side. For example, any of left center panel 42, right center panel 44, or curved side panel 54 may be positioned such that a portion of the panel is approximately 9' 11" from second longitudinal side 16.

At step 616, an intermediate panel is positioned a second distance from the second longitudinal side. For example, any of left intermediate panel 46 or right intermediate panel 48 may be positioned approximately 10' 8" from second longitudinal side 16.

At optional step 618, an end panel may be positioned a third distance from the second longitudinal side. In particular embodiments, the end panel is disposed between the intermediate panel and the first end or the second end.

For example, the end panel may comprise any of left end panel 50, right end panel 52, and curved side panels 56 and 58 as described with respect to FIGS. 1-5. In particular embodiments, a portion of any of left end panel 50, right end panel 52, and curved side panels 56 and 58 may be positioned approximately 10' 3" from second longitudinal side 16.

Modifications, additions, or omissions may be made to the method of FIG. 6. Additionally, one or more steps in method 600 of FIG. 6 may be performed in parallel or in any suitable order.

In particular embodiments, an autorack railcar may be constructed by adding a rack for transporting vehicles to a flatcar. Particular embodiments may include adding side panels, end panels or end doors, and a roof. Conventional flatcars generally have a constant width. In particular embodiments, a flatcar may be constructed with a varying width, such as any of the varying widths described in the embodiments above, for further constructing a variable width autorack railcar.

Although the example embodiments illustrated are symmetrical around a centerline of the autorack railcar, other embodiments may not be symmetrical. Particular embodiments may include articulated autorack railcars or sets of articulated autorack railcars. An example is illustrated in FIGS. 7 and 8.

Figure 7:
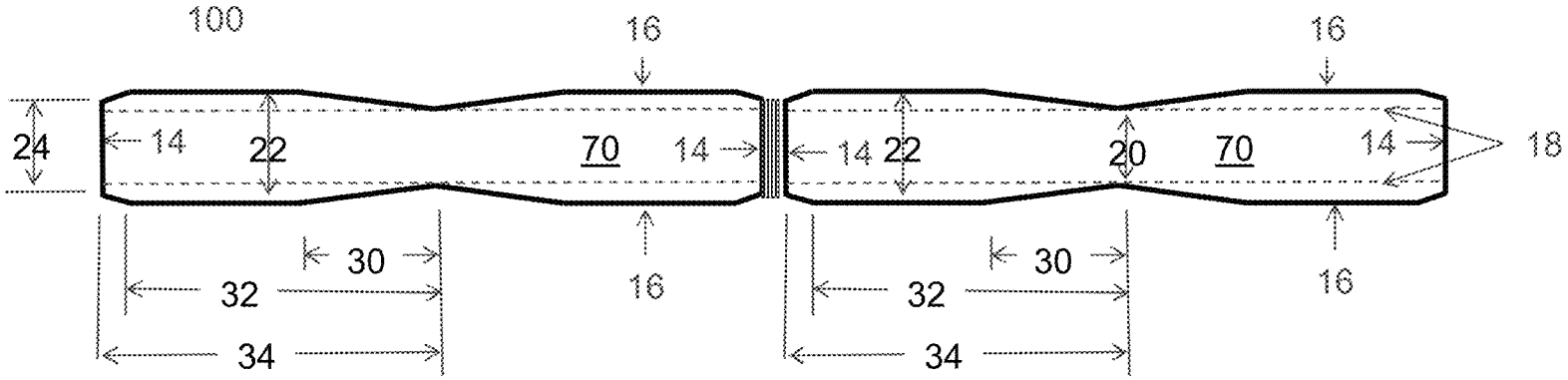
FIG. 7 is a schematic diagram overhead view of an articulated autorack railcar, according to some embodiments.

FIG. 7 is a schematic diagram overhead view of an articulated autorack railcar, according to some embodiments. FIG. 8 is a schematic diagram side view of an articulated autorack railcar, according to some embodiments.

Figure 8:
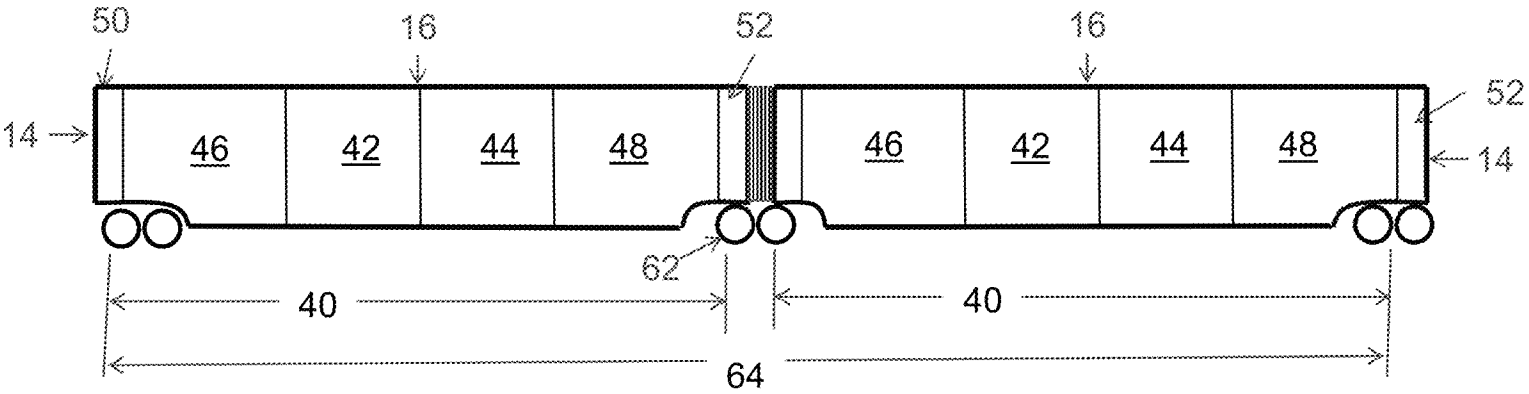
FIG. 8 is a schematic diagram side view of an articulated autorack railcar, according to some embodiments.

As illustrated in FIGS. 7 and 8, articulated railcar 100, such as an autorack railcar, comprises first hourglass railcar 70 and second hourglass railcar 70 coupled via articulated railcar truck 62. Hourglass railcar 70 may comprise an hourglass shaped railcar, such as railcar 10 described with respect to FIGS. 2 and 3 or railcar 60 described with respect to FIGS. 3 and 4.

Railcars 70, each with truck center width 40, when coupled together, comprise articulated railcar 100 with length 64. For example, two 90 foot hourglass railcars with truck center width of 66 feet may be coupled resulting in an approximately 156 foot articulated railcar.

Railcars 70, each with truck center width 40, when coupled together, comprise articulated rail car 100 with length 64. With two 70 foot hourglass railcars with truck center width of 58 feet may be coupled resulting in an approximately 140 foot articulated railcar. Since the truck centers are closer together, the width at the center of each railcar section may be increased by as much as 3 inches compared to railcar sections with 66 foot truck centers.

Method 600 of FIG. 6 may be repeated to manufacture first hourglass railcar 70 and second hourglass railcar 70. The method may include an additional step of coupling the first hourglass railcar to the second hourglass railcar via an articulated railcar truck. Some embodiments of the disclosure may provide one or more technical advantages.

As an example, some embodiments provide interior clearance that improves crew ergonomics by providing more room to conduct normal operations and reduces the likelihood of vehicle damage caused by close working conditions.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Modifications, additions, or omissions may be made to the methods disclosed herein without departing from the scope of the invention. The methods may include more, fewer, or other steps. Additionally, steps may be performed in any suitable order.

Although embodiments of the present disclosure and their advantages have been described in detail, it should be understood that various changes, substitutions and alternations can be made herein without departing from the spirit and scope of the invention as defined by the claims below.

The invention claimed is:

1. An articulated railcar comprising:

a first railcar and a second railcar coupled via an articulated railcar truck;

wherein the first railcar and the second railcar each comprise:

a first end and a second end;

a first longitudinal side and a second longitudinal side disposed between the first end and the second end, wherein:

the first longitudinal side comprises a center panel and an intermediate panel, the center panel disposed between a center of the railcar and the intermediate panel and the intermediate panel disposed between the center panel and the first end or the second end;

a width of the railcar at the intermediate panel is greater than a width of the railcar at the center panel;

the center panel and the intermediate panel comprise generally straight panels coupled together at an angle; and wherein the width of the railcar at the intermediate panel is greater than 9 feet 11 inches and less than 10 feet 8 inches, and the width of the railcar at the center panel varies from approximately 9 feet 11 inches proximate the center of the railcar to between 9 feet 11 inches and 10 feet 8 inches proximate the intermediate panel.

2. The articulated railcar of claim 1, wherein the center panel of each of the first railcar and the second railcar is approximately 18 feet long and the intermediate panel is approximately 25 feet long.

3. The articulated railcar of claim 1, wherein the first longitudinal side of each of the first railcar and the second railcar further comprises an end panel disposed between the intermediate panel and the first end or the second end.

4. The articulated railcar of claim 1, wherein the width of each of the first railcar and the second railcar at the end panel varies from between 9 feet 11 inches and 10 feet 8 inches proximate the intermediate panel to between 9 feet 11 inches and 10 feet 3 inches proximate the first end or the second end.

5. The articulated railcar of claim 3, wherein the end panel of each of the first railcar and the second railcar is approximately 2 feet long.

6. The articulated railcar of claim 3, wherein the end panel of each of the first railcar and the second railcar comprises a generally straight panel.

7. The articulated railcar of claim 1, wherein the width of each of the first railcar and the second railcar at the center panel is generally constant along a vertical dimension of the railcar.

8. The articulated railcar of claim 1, wherein the articulated railcar is approximately 185 feet long.

9. An articulated autorack railcar comprising:

a first autorack railcar and a second autorack railcar coupled via an articulated railcar truck;

wherein the first autorack railcar and the second autorack railcar each comprise:

a first end and a second end;

a first longitudinal side and a second longitudinal side disposed between the first end and the second end;

a rack for transporting vehicles generally enclosed by the first end, the second end, the first longitudinal aide, and the second longitudinal side, wherein:

a first width of the autorack railcar between the first longitudinal side and the second longitudinal side proximate a center of the autorack railcar comprises a first width value;

a second width of the autorack railcar between the first longitudinal side and the second longitudinal side between the center of the autorack railcar and either the first end or the second end comprises a second width value, the second width value greater than the first width value; wherein:

the first width and the second width are generally constant along a vertical dimension of the autorack railcar; and the first width value is less than or equal to 9 feet 11 inches.

10. The articulated autorack railcar of claim 9, wherein the second width value of each of the first autorack railcar and the second autorack railcar is between 9 feet 11 inches and 10 feet 8 inches.

11. The articulated autorack railcar of claim 9, wherein a third width of each of the first autorack railcar and the second autorack railcar between the first longitudinal side and the second longitudinal side proximate either the first end or the second end comprises a third width value, the third width value greater than or equal to the first width value and less than or equal to the second width value.

12. The articulated autorack railcar of claim 11, wherein the third width value of each of the first autorack railcar and the second autorack railcar is between 9 feet 11 inches and 10 feet 3 inches.

13. The articulated autorack railcar of claim 11, wherein the third width value of each of the first autorack railcar and the second autorack railcar is generally constant along a vertical dimension of the autorack railcar.

14. The articulated autorack railcar of claim 9, wherein the articulated railcar has truck centers of 66 feet and is approximately 156 feet long.

15. The articulated autorack railcar of claim 9, wherein the articulated railcar has truck centers of 58 feet and is approximately 140 feet long.

16. The articulated autorack railcar of claim 15, wherein the first width value of each of the first autorack railcar and the second autorack railcar is approximately 3 inches wider than an articulated railcar that has truck centers of 66 feet and is approximately 156 feet long.

17. A method of manufacturing an articulated autorack railcar, the method comprising:

for each of a first autorack railcar and a second autorack railcar:

providing a first end and a second end;

coupling a first longitudinal side and a second longitudinal side between the first end and the second end to enclose a rack for transporting vehicles, the first longitudinal side comprising a center panel and an intermediate panel, the center panel disposed between a center of the railcar and the intermediate panel and the intermediate panel disposed between the center panel and the first end or the second end, wherein the center panel and the intermediate panel comprise generally straight panels;

positioning the center panel a first distance from the second longitudinal side;

positioning the intermediate panel a second distance from the second longitudinal side, the second distance greater than the first distance;

wherein the first distance is less than or equal to 9 feet 11 inches; and coupling the first autorack railcar to the second autorack railcar via an articulated railcar truck.

18. The method of claim 15, wherein the second distance of each of the first autorack railcar and the second autorack railcar is greater than 9 feet 11 inches.

19. The method of claim 15, wherein the first longitudinal side of each of the first autorack railcar and the second autorack railcar further comprises an end panel disposed between the intermediate panel and the first end or the second end and the method further comprises positioning the end panel a third distance from the second longitudinal side.

20. The method of claim 17, wherein the third distance of each of the first autorack railcar and the second autorack railcar is greater than or equal to the first distance and is less than or equal to the second distance.

* * * * *